US009533232B2

(12) United States Patent
Braun

(10) Patent No.: US 9,533,232 B2
(45) Date of Patent: Jan. 3, 2017

(54) LAUNCHER FOR A SLIDE AS WELL AS METHOD FOR LAUNCHING A SLIDE RUN IN A SLIDE CHUTE

(71) Applicant: AQUARENA GMBH, Jettingen (DE)

(72) Inventor: Rainer Braun, Magstadt (DE)

(73) Assignee: AQUARENA HOLDING GMBH, Jettingen (DE)

( * ) Notice: Subject to any disclaimer, the term of this patent is extended or adjusted under 35 U.S.C. 154(b) by 0 days.

(21) Appl. No.: 14/779,192

(22) PCT Filed: Mar. 10, 2014

(86) PCT No.: PCT/EP2014/054541

§ 371 (c)(1),
(2) Date: Sep. 22, 2015

(87) PCT Pub. No.: WO2014/146918

PCT Pub. Date: Sep. 25, 2014

(65) Prior Publication Data

US 2016/0059138 A1 Mar. 3, 2016

(30) Foreign Application Priority Data

Mar. 22, 2013 (DE) ..... 10 2013 102 945

(51) Int. Cl.
*A63G 21/00* (2006.01)
*A63G 21/18* (2006.01)
*A63K 3/02* (2006.01)

(52) U.S. Cl.
CPC ..... *A63G 21/18* (2013.01); *A63K 3/02* (2013.01)

(58) Field of Classification Search
CPC ..... A63G 21/00; A63G 21/18; A63G 31/00; A63G 31/02; A63G 31/007; A63B 2225/60
(Continued)

(56) References Cited

U.S. PATENT DOCUMENTS 5,167,321 A * 12/1992 Brodrick, Sr. ..... B65G 51/01 104/73
5,183,437 A 2/1993 Millay et al.
(Continued)

FOREIGN PATENT DOCUMENTS

CN 202590349 U 12/2012
DE 20120561 U1 3/2002
(Continued)

OTHER PUBLICATIONS

International Preliminary Report on Patentability dated Sep. 22, 2015, in PCT Application No. PCT/EP2014/054541.

*Primary Examiner* — Kien Nguyen
(74) *Attorney, Agent, or Firm* — Kriegsman & Kriegsman

(57) ABSTRACT

Launcher for a slide and method for starting a sliding process in a slide way, in particular a water slide, having a starting ramp, which includes a slide section having a slide surface, which has a loading zone for at least one user, which extends from an entry-side end of the slide section to a blocking device arranged in the slide section, the blocking device blocking the slide surface when in a starting position, and having a pivoting device, by which the starting ramp can be moved from a loading position to a starting position, and having a control device, which actuates the pivoting movement of the starting ramp between the loading position and the starting position and the blocking device between the starting position and a release position.

19 Claims, 5 Drawing Sheets

Figure 1:
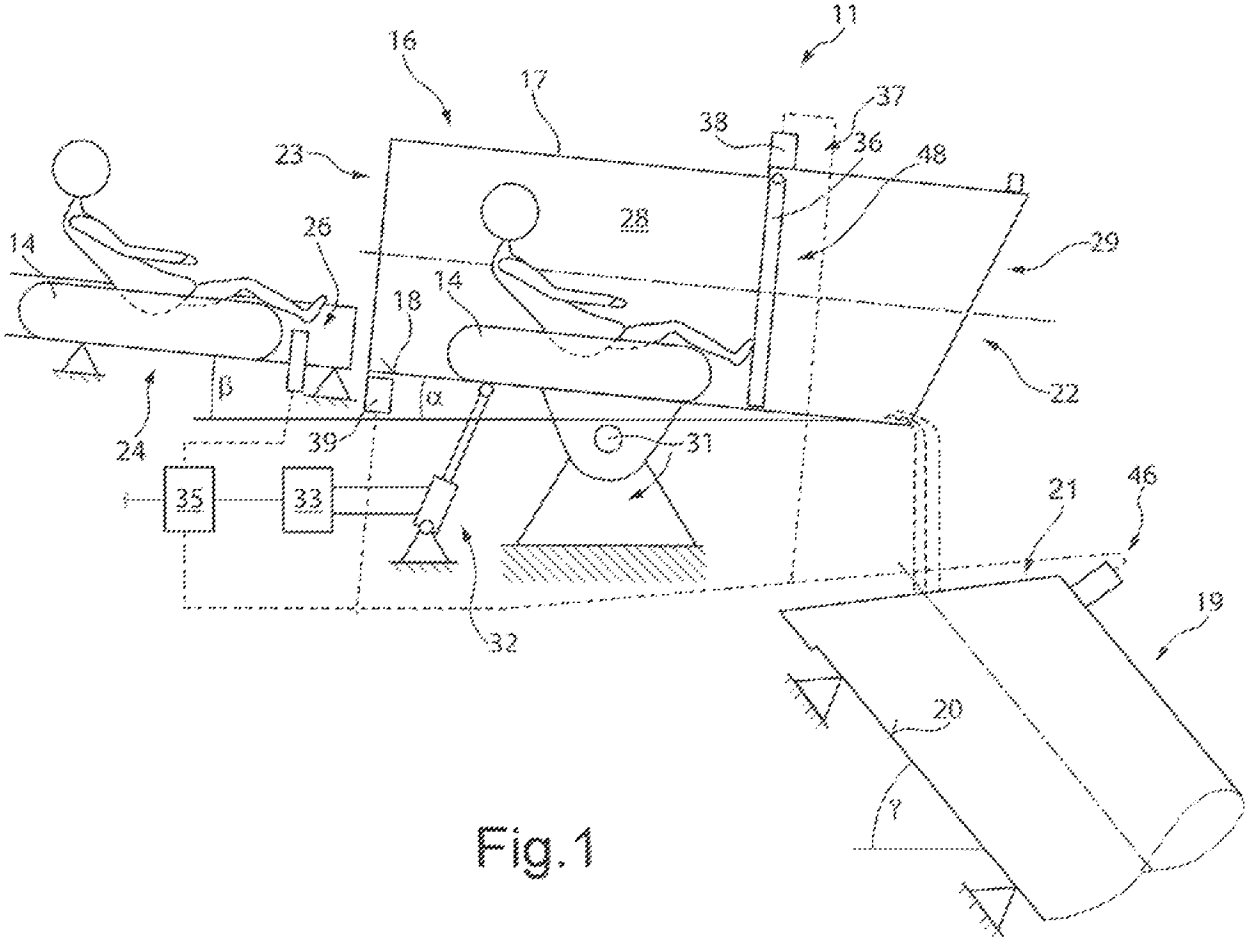

(58) Field of Classification Search
USPC ..... 472/13, 117, 128, 129; 104/53, 60, 69, 104/70, 73
See application file for complete search history.

(56) References Cited

U.S. PATENT DOCUMENTS

| | | | | |
|---|---|---|---|---|
| 5,704,294 | A * | 1/1998 | Van Winkle ..... | A63C 19/00 104/60 |
| 7,833,107 | B1 | 11/2010 | Garcia-Morales | |
| 2005/0288113 | A1 | 12/2005 | Langford | |

FOREIGN PATENT DOCUMENTS

| | | | |
|---|---|---|---|
| DE | 102006062349 | A1 | 6/2008 |
| EP | 2500070 | A1 | 9/2012 |
| WO | 0154783 | A1 | 8/2001 |

* cited by examiner

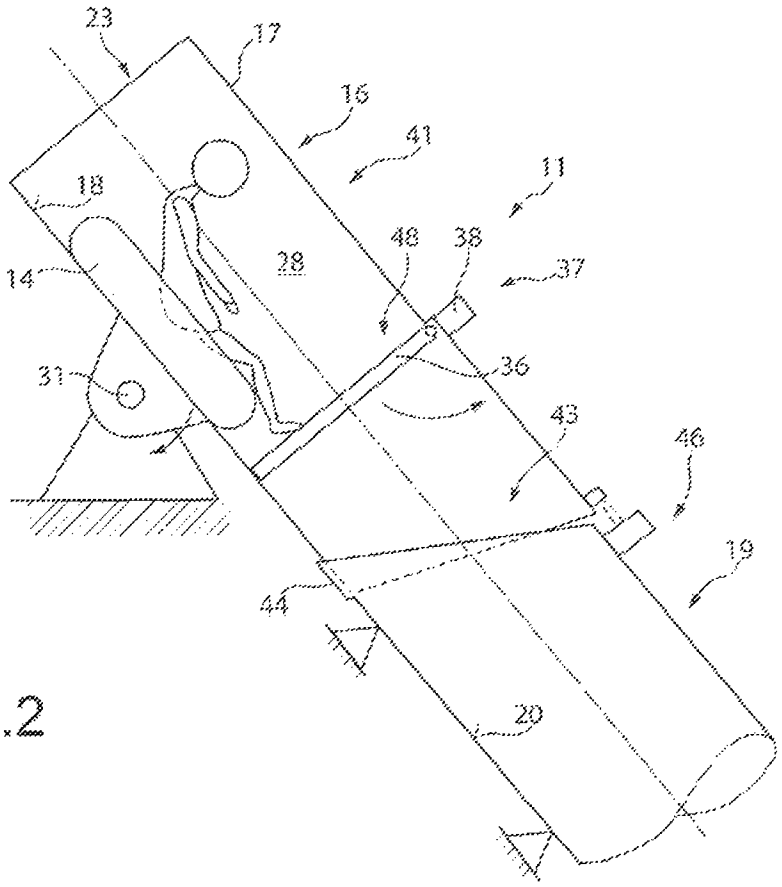
Fig.2
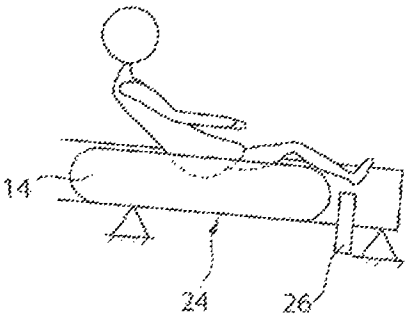

LAUNCHER FOR A SLIDE AS WELL AS METHOD FOR LAUNCHING A SLIDE RUN IN A SLIDE CHUTE

The invention relates to a launcher for a slide as well as a method for launching a slide run in a slide chute for at least one user, in particular in a water slide chute.

A water slide is known from DE 10 2006 062 349 in which a slide chute has a run-up section and an outlet section flowing into an outlet, wherein at least one loop section is provided between the run-up section and the outlet section which has a circumferential angle of at least 270° and is inclined by 5° to 80° compared to a vertical at least between a launch point and an apex of the loop section. Such a looping slide is used in water parks or adventure parks and increases the attraction of such parks.

The requirements for the attraction of such parks, in particular the slides thereof, are constantly increasing.

The object of the invention is to create a further attraction for slides, in particular water slides.

This object is solved by a launcher for a slide, in particular a water slide, having the features of claim 1.

Using a launch ramp of the launcher, it is enabled that a person is able to be transferred from a loading position of the launch ramp in which a slide surface is arranged to be substantially horizontal or slightly inclined, into a launch position from which the user experiences increased acceleration due to the incline of the slide surface in the launch position after the release of the launch position by the blocking device. The blocking device releases the slide surface after assumption of the launch position, whereby the impression of increased acceleration or even a free fall depending on the incline can be imparted to the user in a first launch phase. The attraction of such a slide is thereby increased even in the launch phase. Such a launcher can be used both for a slide in which the user slides in his clothes on the slide surface or with aids such as, for example, a mat, and for water slides which can be used with and without tyres.

Preferably, the launch ramp and/or the first slide element or the slide element allocated to the outlet-side end of the launch ramp is formed to be tubular. The tubular design is advantageous, in particular in the case of a high launch incline of the slide surface in the launch phase of the launch ramp in order to keep the user safely within the slide chute. Preferably, the launch ramp and/or the first slide element can be formed to be transparent or at least partially transparent.

A further preferred embodiment of the launcher provides that, in a loading position of the launch ramp, an outlet-side end of the launch ramp is arranged separately to the inlet-side end of the first slide element of the slide chute which is allocated to the launch ramp. Therefore, the launch ramp is received to be pivotable around a pivot axis which is arranged separately to the slide element. Such an arrangement can have advantages for the control of the pivot movement as lower pivot forces can be required.

Preferably, in the case of the embodiment above, the slide surface of the outlet-side end of the slide element of the launch ramp is set back compared to an upper section of the slide element. An outlet-side end of the launch ramp which runs at an angle is thereby created which corresponds to a complementarily-formed inlet-side end of the slide element. This enables a simple pivoting together of the outlet-side end of the launch ramp to the fixedly-arranged first slide element.

An alternative embodiment of the launcher provides that an outlet-side end of the launch ramp and an inlet-side end of the first slide element allocated to the launch ramp are connected to each other with an articulated joint, preferably adjacent in or on the slide surface. This arrangement enables a firm connection between the fixed first slide element and the pivotable slide section of the launch ramp with respect to each other and therefore a simple folding mechanism.

Advantageously, the slide section of the launch ramp and the first slide element are formed and are allocated to each other in such a way that a closed transition is formed during the positioning of the launch ramp in the launch position between the two. Safe sliding can thereby be enabled, wherein at the same time a larger angular range between the positioning of the slide surface of the launch ramp in the loading position and in the launch position is enabled.

Preferably, the closed transition between the slide section of the launch ramp in the launch position and the first slide element is detected using a monitoring device which emits a release signal to control the blocking device only after proper assumption of the launch position. It can thereby be ensured that the blocking device only then releases the slide surface when the transition is closed. Alternatively it can be provided that the user located in the loading zone can manually trigger the launch procedure, so the opening of the blocking device from an initial position into a release position, himself, wherein this self-triggering is only then possible after the monitoring device has emitted a release signal.

The outlet-side end of the slide section of the launch ramp is adapted to the inlet-side region of the first slide element at least in the region of the slide surface or overlaps this. An injury-free transition can thereby be formed. Additionally, a loss-free water supply in the case of the design of a water slide is also provided without a liquid supporting the slide run escaping at the junction.

Furthermore, preferably, the slide surface of the launch ramp is able to be transferred into the incline of the slide surface of the first slide element. A particularly good launch phase having a high acceleration can thereby be achieved.

The launch ramp is preferably arranged to be pivotable in a region from 0° to 90° around a bearing axis. On the one hand, a simple loading and on the other hand, a maximum acceleration in the launch phase can thereby be achieved. Preferably, the pivot region is formed between 5° and 85°.

Furthermore, preferably the slide surface of the launch ramp is able to be transferred from a loading position with an incline from 0° to 15° compared to the horizontal, into a launch position from 15° to 89°, preferably 45° to 90°, and in particular 60° to 85°.

The blocking element provided in the launch ramp is formed as a pivotable or displaceable blocking element which is controlled and monitored by a control device and is actuated by a drive element. Preferably, a valvular element or a trapdoor, or even a double trapdoor, is used.

The blocking element is preferably arranged to be pivotable and/or displaceable outside of the slide surface. The slide surface can thereby be formed without interruption such that there are optimal slide ratios during the launch phase and a direct sliding of persons on the slide surface is also enabled.

In the event of use of the launch ramp for a launcher for water slides, a front side of the blocking element of the blocking device is preferably arranged at a short distance to the slide surface. The blocking element thereby fulfils a type of water accumulation function. This means that a water film can accumulate on the slide surface, whereby in turn the launch conditions are supported.

A further advantageous embodiment of the method provides that a conveyance device is allocated to the loading zone of the launch ramp which is formed as a slide surface, as a roller belt or as a transport conveyor belt. A quick and safe filling of the loading zone of the launch ramp can thereby be enabled in order to achieve a short cycle time for the slide runs. Preferably, a separation device is provided between the conveyor device and the launch ramp or in the conveyor device. This is used in particular in the case of a tyre slide.

The object on which the invention is based is furthermore solved by a method according to the features of claim 15. In the method for launching a slide run in a slide chute having at least one user having a launcher of the type referred to above, the blocking device in the launch ramp is released only after the secure transfer of the launch ramp from a loading position into a launch position in order to be begin the slide run. This enables a controlled and monitored use of such a slide chute having increased attraction even in the launch phase of the slide run.

Figure 3:
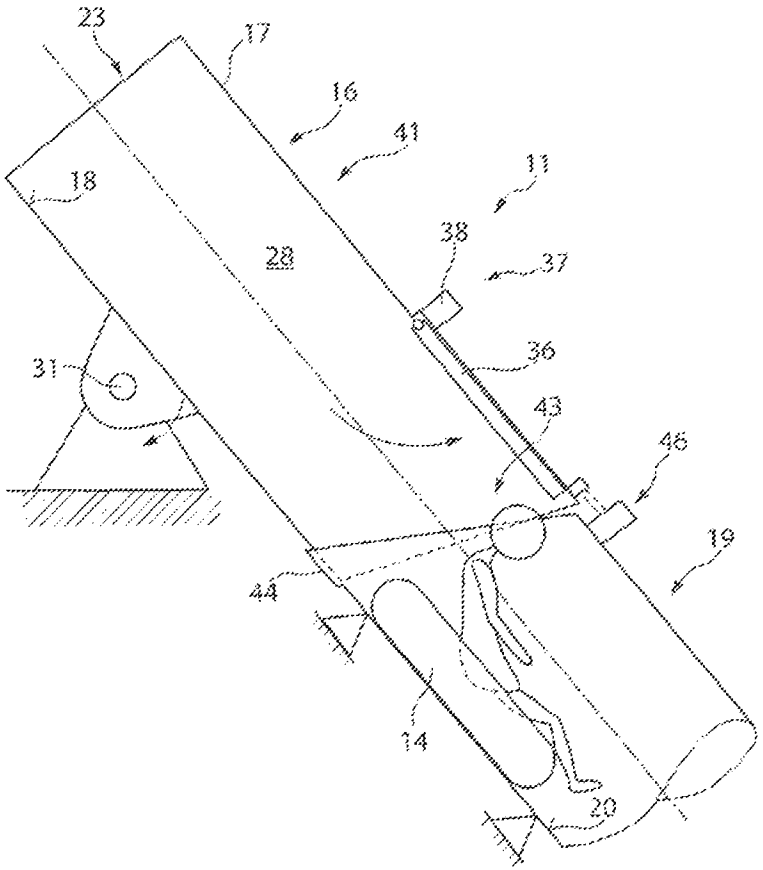
Figure 3:
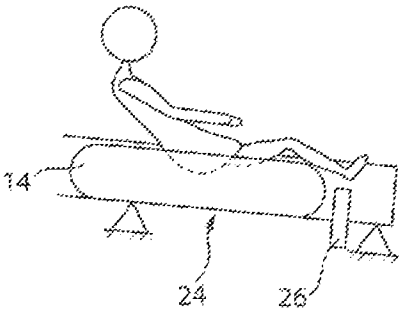
Figure 4:
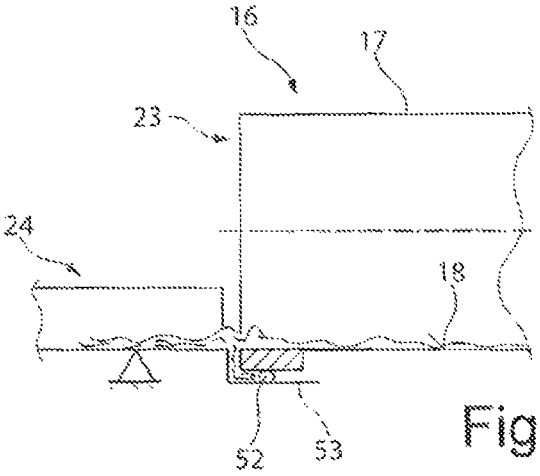
Figure 5:
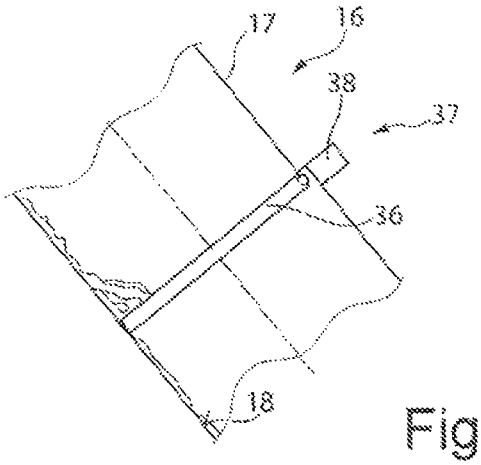
Figure 6:
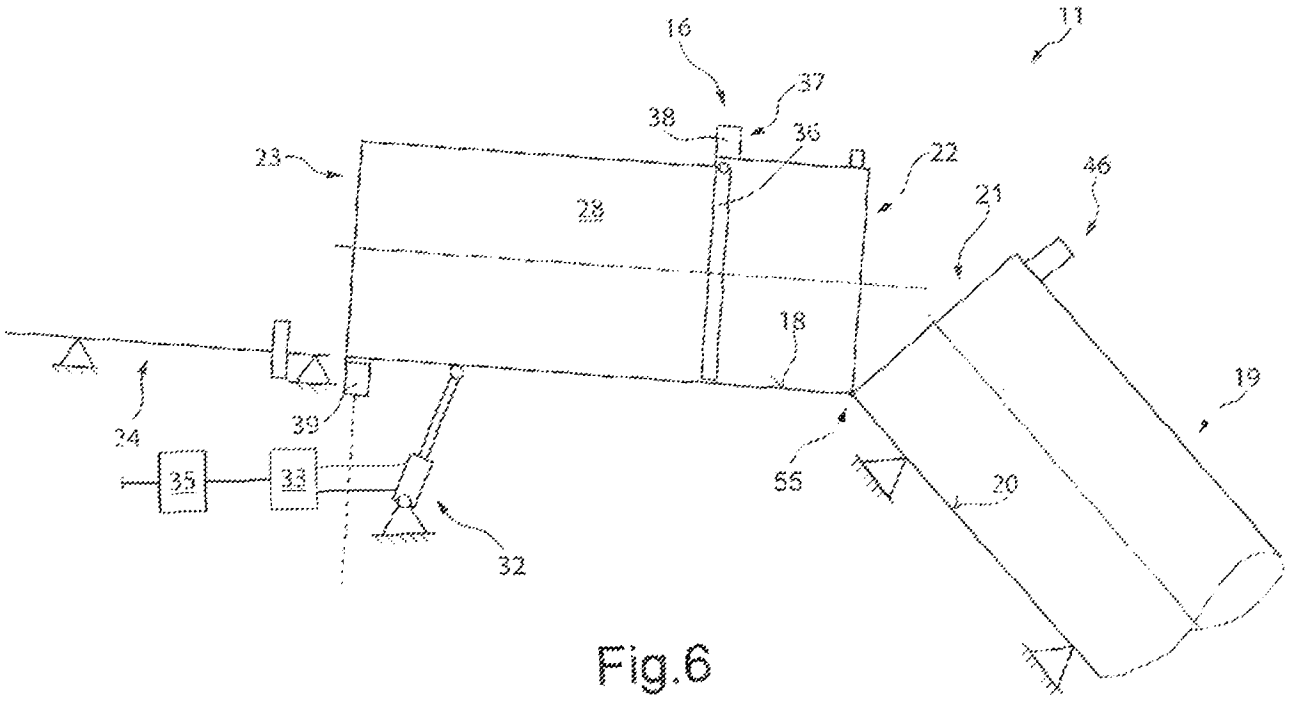

The invention as well as further advantageous embodiments and developments of the same are described and explained in more detail below by means of the examples depicted in the drawings. The features to be gleaned from the description and the drawings can be applied individually or together in any combination according to the invention. Here are shown:

FIG. 1 a schematic side view of a launcher according to the invention having a launch ramp in a loading position, FIG. 2 a schematic side view of the launcher according to FIG. 1 having the launch ramp in a launch position, FIG. 3 a schematic side view of the launcher according to FIG. 2 after release of a blocking device, FIG. 4 a schematic detailed view of an inlet region of the launch ramp, FIG. 5 a schematic detailed view of the blocking device in the launch ramp and FIG. 6 a schematic side view of an alternative embodiment of the launcher according to FIG. 1.

In FIG. 1, a schematic side view of a launcher 11 according to the invention is depicted for a slide which is not depicted in more detail. Such a slide can be so-called dry slides, so slides in which the sliding person slides directly along the slide surface or slides by means of a mat or a rug. In particular, these slides are formed as water slides, wherein the user can slide both directly on a water film on the slide surface or on a tyre.

The launcher 11 comprises at least one launch ramp 16 which comprises a slide section 17 having a slide surface 18. Furthermore, the launch ramp 16 can comprise a first slide element 19 which is adapted to an outlet-side end 22 of the launch ramp 16 with the inlet-side end 21 thereof.

The launch ramp 26 furthermore comprises a pivot device 30 with a bearing axis 31 around which the slide section 17 is arranged to be able to pivot. For the control of the pivot movement, the pivot device 30 comprises a drive and an actuator, such as, for example a lifting cylinder 32 which is depicted symbolically. This lifting cylinder 32 can be controlled hydraulically, pneumatically or in another way by a corresponding drive device 33 which is in turn controlled and monitored by a control device 35. Alternatively to the lifting cylinder 32, an electromotor, electromagnetic drive as well as a drive by means of a gear can also be provided which initiates a pivot movement of the bearing axis 31 and therefore of the slide section 17, whereby the slide section 17 is pivoted around the bearing axis 31.

A conveyor device 24 is allocated to an inlet-side end 23 of the launch ramp 16, said conveyor device 24 having a transport plane which is inclined slightly at an angle β compared to the horizontal. In this case, the conveyor device 24 is formed as a slide surface or roller belt. The conveyor device 24 can also be formed as a transport conveyor device having a driven transport belt. In this embodiment, the incline angle β can also be equal to zero.

The conveyor device 24 can comprise a separating device 26 using which controlled access into a loading zone 28 of the launch ramp 16 can be controlled. Alternatively to the separation device 26, a signal device can also be provided which is controlled via sensors which are provided at the inlet-side end 23 of the launch ramp 16 and/or on the conveyor device 24.

The slide section 17 of the launch ramp 16 is preferably formed as closed tubes. A loading zone 28 extends from an inlet-side end 23 to the blocking device 37. This loading zone 28 can extend in length in such a way that only one user, in particular with a tyre, can be received therein. Likewise, the loading zone 28 can also be formed for a double tyre or other slide aids, in particular for two, three or more people sliding together.

The blocking device 37 comprises a blocking element 36 which preferably extends completely over the cross-section of the tubular slide section 17, such that the slide section 17 is completely closed. A front-side end of the blocking element 36 which points towards the slide surface is preferably arranged at a short distance to the slide surface, such that a minimum quantity of liquid can enter in the case of use with a water slide.

The blocking element 36 can be pivoted upwards around a pivot axis arranged on the upper section of the slide section 17 and is preferably formed as a pivotable flap or trapdoor which is driven using the control device via a drive 38.

The slide section 17 of the launch ramp 16 and/or the first slide element 19 can, for example, be formed as a sliding surface or flat surface. Likewise, the slide surface 18 can be formed by rollers or a transport or roller belt. Likewise, alternatively, a trough-shaped slide surface 18, 20 can also be provided which is open upwardly. In this instance, however, the lateral edges are formed to be superelevated compared to the slide surface 18, 20 in order to guide the sliding person along the slide surface 18, 20. A water supply, in the case of a water slide, can occur directly into the first slide element 19 at the beginning of the slide surface 20 or already before this in the launch ramp 16, such that water flows into the slide element 19, wherein the first slide element 19 can also be additionally supplied with water.

The conveyor device 24, in the case of the design as a slide surface, can be adapted to the previously described alternative embodiment of the slide section 17. The same applies for the first slide element 19.

If the conveyor device 24 and/or the slide surfaces 18, 20 comprise rollers or a conveyor belt, sliding aids, such as, for example, mats, tyres or similar, are preferably used.

In FIG. 1, the launch ramp 16 is arranged in a loading position 29. In this loading position 29, the slide surface 18 of the slide section 17 can be inclined at an angle α which preferably corresponds to the angle β of the conveyor device 24. Alternatively, the incline of the angle α can also deviate from the angle β. If a conveyor device 24 is formed as a slide surface or roller belt, the slide surface 18 is preferably arranged in a slightly inclined position, for example in a range from 1° to 15°, such that, after the entry of the user into the loading zone 28, this slides independently to the blocking element 36 of the blocking device 37. If the conveyor device 24 is formed as a transport conveyor belt, the incline angle α can also amount to 0°, as a safe sliding of the user into the loading zone is provided by the drive of the conveyor device. Alternatively or additionally, the sliding surface 18 of the sliding section 17 of the launch ramp 16 has a driven roller belt or a driven transport conveyor belt in order to enable a safe loading. The latter is provided in particular in the case of tyre slides.

In the case of the design of a tubular slide section 17 and a tubular first slide element 19 according to FIG. 1, the respective front-side ends 21, 22 are adapted to each other such that these form a closed transition 43 in the case of the transfer of the launch ramp 16 from the loading position 29 depicted in FIG. 1 into a launch position 41 depicted in FIG. 2. Here, according to a preferred embodiment, it can be provided that the slide surface 18 of the slide section 17 is supported on a deepened receiving section 44 of the first slide element 18, such that the slide surfaces 18, 20 of the slide section 17 and the slide element 19 merge into each other to be flush. This has the advantage that, in particular in the case of a water slide, a particularly good water supply is also enabled. At the same time, the risk of injury can be reduced by the intermeshing of the slide section 17 in the first slide element 19 during sliding. Alternatively it can also be provided that the respective front-side ends 21, 22 are positioned for flush contact and/or have intermeshing connection sections such that, when travelling over the respective ends 21, 22, a stable arrangement of the junction point is provided.

The slide element 19 is arranged at an angle γ compared to the horizontal which is formed, for example, to be smaller than 89°, wherein preferably an angle is set which ranges from greater than 45°, in particular greater than 60°, and in particular in the range from 75° to 85°. A particularly high acceleration can thereby be achieved.

The loading position 29 of the launch ramp 16 is monitored by sensors 39 which are coupled to the control device 35. These sensors 39 can also detect the loading of the loading zone 28. After a loading of the loading zone 28 by means of at least one user has occurred in the loading position 29, the control device 35 receives a corresponding signal. Alternatively, this can also be triggered manually by the user in the loading zone 28. Subsequently, the launch ramp 16 can be transferred from the loading position 29 into a launch position 41 according to FIG. 2 via the drive device 33.

After the transfer of the launch ramp 16 from the loading position 29 into the launch position 41 according to FIG. 2, the arrangement of the slide section 17 and of the slide element 19 is checked with respect to a closed transition 43 with a monitoring device 46. As soon as it is ensured by the monitoring device 46 that the transition 43 is closed in the launch position 41, a signal is emitted to the control device 35 that the blocking device 37 can now be released, such that the drive 38 controls an opening of the blocking element 36. For example, a countdown launch phase can be initiated. The opening time of the blocking device can also be selected and controlled according to a random number generator after assumption of the launch position 41, such that the launch release causes a surprise effect for the user. Alternatively the user can also trigger the launch procedure with or without a countdown by actuating a launch button, using which the blocking element 36 is transferred from an initial position 38 or closed or blocking position into a release position 50 according to FIG. 3. The slide run for the user begins directly after the pivoting of the blocking device 37 into the release position 50.

After the user has left the launch ramp 16 due to the transfer of the blocking device 37 into the release position 50, the sliding out from the launch ramp 16, for example by sensors in the slide section 17 of the launch ramp 16 or by sensors in the first slide element 19, can be detected or can be detected by a predetermined time expiry after transfer of the blocking device 37 from the initial position 48 into the release position 50, such that, in connection to this, the launch ramp 16 is guided back into the loading position 29 and the blocking element 36 is guided back into the initial position 48 via the control device 35. Subsequently, the loading procedure of the launcher 11 can occur again, after the sensors 39 have detected the assumption of the loading position 29 of the launch ramp 16.

In the case of the launcher 11 according to FIGS. 1 to 3, in which the launch ramp 16 having the slide section 17 thereof is arranged separately to the slide element 18, the ends 22, 21 which are allocated to each other are preferably designed in such a way that, as is depicted in FIG. 1, in the case of application in the water slide, the water 16 supplied to the launch ramp 16 directly reaches the slide element 19 when escaping from the slide section 17. An application device can be allocated to the junction point in order to receive the leakage water.

In FIG. 4, a schematically enlarged view of the launch ramp 16 of the launcher 11 is depicted in the case of the application as a water slide. The conveyor device 24 likewise guides water onto the slide surface. In the loading position 29 of the launch ramp 16, a sealing element 52 arranged on the launch ramp 16 is supported on a support element 53 which extends laterally until above the slide surface and, for example, is fastened to the conveyor device 24. The water collecting in the gap can thereby be accumulated and the junction point can be sealed such that no water loss occurs, but rather the water supplied via the conveyor device 24 reaches the loading zone 28 of the launch ramp 16.

In FIG. 5, a schematically enlarged depiction of the blocking device 39 is depicted in the initial or blocking position 48 in the slide section 17. The end of the blocking element 36 allocated to the slide surface 18 is arranged at a slight distance to this, whereby an accumulation of the water is achieved. A favourable launch position can thereby be enabled by a sliding of the user on a water film on the slide surface 18.

In FIG. 6, an alternative embodiment of the launcher 11 to FIGS. 1 to 3 is depicted. This embodiment deviates to the effect that the slide section 17 is connected to the slide element 19 via an articulated joint 55. This articulated joint lies in the region of or underneath the sliding surface 18. This arrangement likewise enables a closed transition 43 of the joint position after the transfer of the launch ramp 16 from the loading position 29 into the launch position 41, such that risk-free sliding is provided. Apart from this, alternatives and/or preferred embodiments apply which have been described with respect to FIGS. 1 to 5.

The features referred to previously are each significant features of the invention alone or in any combination.

The invention claimed is:

1. Launcher for a slide, having a launch ramp which comprises a slide section having a slide surface which has a loading zone for at least one user which extends from an inlet-side end of the slide section to a blocking device arranged in the slide section, wherein the blocking device blocks the slide surface in an initial position, having a pivot device using which the launch ramp is able to be transferred from a loading position into a launch position in which the launch ramp and a first slide element of the slide are allocated to each other, and having a control device which controls the pivot movement of the launch ramp between the loading position and the launch position and the blocking device between the initial position and a release position.

2. Launcher according to claim 1, wherein at least one of the launch ramp and the first slide element of the slide allocated to the outlet-side end of the launch ramp is formed to be tubular.

3. Launcher according to claim 1, wherein in the loading position of the launch ramp, an outlet-side end of the launch ramp is arranged separately to the inlet-side end of the first slide element.

4. Launcher according to claim 1, wherein an outlet-side end of the launch ramp and an inlet-side end of the first slide element are connected to each other with an articulated joint.

5. Launcher according to claim 4, wherein the outlet-side end of the launch ramp on the inlet-side end of the first side element are connected with an articulated joint adjacently in or on the sliding surface.

6. Launcher according to claim 1, wherein the slide section of the launch ramp arranged in the launch position and the first slide element form a closed transition.

7. Launcher according to claim 6, wherein the closed transition is able to be detected with a monitoring device and a release signal is emitted to control the blocking device.

8. Launcher according to claim 1, wherein the outlet-side end of the slide section of the launch ramp engages with the inlet-side end of the first slide element in the region of the slide surface or overlaps this.

9. Launcher according to claim 1, wherein the slide surface of the launch ramp is able to be transferred into the incline of the slide surface of the slide element and forms a mutual slide plane.

10. Launcher according to claim 1, wherein the launch ramp is able to pivot in the range from 0° to 90°, or in the range from 5° to 85°.

11. Launcher according to claim 1, wherein the slide surface of the launch ramp is able to pivot from a loading position having an incline of 0° to 15° compared to the horizontal, into a launch position from 5° to 89°.

12. Launcher according to claim 1, wherein the blocking device comprises a drive and at least one blocking element which is preferably formed as a pivotable or displaceable blocking element.

13. Launcher according to claim 12, wherein the blocking device comprises a drive and at least one blocking element which is formed as a pivotable or displaceable blocking element.

14. Launcher according to claim 1, wherein the blocking element is arranged outside the slide surface to be pivotable or displaceable in the slide section.

15. Launcher according to claim 1, wherein a front side of the blocking device which points towards the slide surface is arranged at a short distance to the slide surface with a water accumulation function.

16. Launcher according to claim 1, wherein a conveyor device is allocated to the loading zone of the launch ramp which is formed as a slide surface, as a roller belt or a transport conveyor belt.

17. Launcher according to claim 16, wherein a separating device or a signal device is provided in the conveyor device or between the conveyor device and the launch ramp.

18. Launcher according to claim 1, wherein the slide surface of the front-side end of the slide section is set back compared to an upper section of the slide section.

19. Method to launch a slide run in a slide chute for at least one user, in which the at least one user independently slides or is conveyed into a loading zone of a launch ramp of the launcher, which is limited by a blocking device allocated to a slide surface of the launch ramp in the slide direction, in which, after the loading of the loading zone, the launch ramp is transferred from a loading position into a launch position such that the slide surface of the launch ramp merges into a slide surface of a first slide element connected to the launch ramp, in which, after the assumption of the launch position, the blocking device is controlled and is transferred from an initial position into a release position.

* * * * *